United States Patent [19]

LaWall

[11] Patent Number: 4,871,066

[45] Date of Patent: Oct. 3, 1989

[54] TELESCOPING FILE FOLDERS

[75] Inventor: David LaWall, Ardmore, Pa.

[73] Assignee: David Eckhart, Westlake Village, Calif. ; a part interest

[21] Appl. No.: 229,570

[22] Filed: Aug. 5, 1988

[51] Int. Cl.[4] ..... B56D 26/10

[52] U.S. Cl. ..... 206/425; 206/499; 206/444; 206/312; 206/459; 190/110

[58] Field of Search ..... 206/499, 444, 312, 459, 206/425, 45; 190/109, 110; 229/1.5

[56] References Cited

U.S. PATENT DOCUMENTS

| | | | |
|---|---|---|---|
| 508,394 | 11/1893 | Andrews | 206/425 |
| 533,053 | 1/1895 | Cooke, Jr. | 206/425 |
| 898,034 | 9/1908 | Brunn . | |
| 972,302 | 10/1910 | Waller . | |
| 1,238,332 | 8/1917 | Rand, Jr. . | |
| 1,539,411 | 5/1925 | Davis . | |
| 1,721,248 | 7/1929 | Davis . | |
| 1,889,765 | 12/1932 | Switkes | 190/110 |
| 1,929,615 | 10/1933 | Tanner | 206/45 |
| 1,940,900 | 12/1933 | Barnard | 190/110 |
| 2,316,328 | 4/1943 | Guenther et al. | 190/110 |
| 2,524,965 | 10/1950 | Eddy | 129/16.5 |
| 3,659,703 | 5/1972 | Oliver | 206/425 |
| 4,444,314 | 4/1984 | Jacobsson | 206/425 |
| 4,531,667 | 7/1985 | Meade | 229/1.5 R |
| 4,589,544 | 5/1986 | Schweinsberg | 206/425 |
| 4,706,396 | 11/1987 | Nomura | 40/124.2 |
| 4,730,727 | 3/1988 | Petroff | 206/425 |

FOREIGN PATENT DOCUMENTS

| | | | |
|---|---|---|---|
| 325472 | 9/1920 | Fed. Rep. of Germany | 206/425 |
| 1902482 | 7/1978 | Fed. Rep. of Germany | 206/425 |
| 2905704 | 8/1980 | Fed. Rep. of Germany | 206/425 |

*Primary Examiner*—William Price

*Attorney, Agent, or Firm*—Steele, Gould & Fried

[57] ABSTRACT

A container defines a pocket for receipt of articles, the pocket being bounded by a front panel and a rear panel. A connecting flap extends from the rear panel along a fold line, the conncting flap being dimensioned to fit into the pocket of a next container and the fold line on each container being spaced above a top edge of a front panel defining the pocket. Accordingly, a front and a rear container attached by means of the connecting flap of one being inserted in the pocket of the next, can be placed in registry or lifted out of registry, the containers telescoping until the connecting flap of the front container, becomes fixed in the pocket by either bottoming out or by encountering the top edge of the pocket, whereupon the telescoping containers lift one another, exposing an edge of the rear panel and/or connecting flap on the rear container. The container is useful for file folders, diskette folders and other article-receiving means, both loosely movable and mounted in file cabinets, briefcases or wall mounts.

13 Claims, 3 Drawing Sheets

TELESCOPING FILE FOLDERS

BACKGROUND OF THE INVENTION

1. Field of the Invention

The invention relates to the field of containers for grouping articles in categories, especially for grouping sheet-like articles in containers which can be stored in registry and are moved out of registry for viewing at least along an edge, the containers each being carried along by a next container in a stack.

2. Prior Art

Many forms of article-receiving files and like elements are known, being commonly stored in registry with one another in file cabinets, on shelves and in bins provided for that purpose. When the article-receiving filing elements are positioned in registry, i.e. aligned precisely one on top of the other or one along side the other, depending upon the orientation of the registered stack, the faces of the article-receiving elements are covered by the next successive article-receiving elements on either side thereof. The faces are not visible for labels because they are covered in the stack. This is true of many common items normally stored in registry, for example, office files, record albums, computer diskettes, books and pamphlets, etc. Therefore, particularly when the article receiving elements are flat and all the same size, such as office files, photographs, information storage media and other items produced in standard sizes, the large front and rear panels and any labeling which may appear there are wasted so long as the items are stored in registry.

The widest faces of these flat elements are covered by the next of the elements in the stack. Therefore, one either labels the very small edge of the item, or means must to be provided to allow the items in registry to tilt or be displaced such that at least a short area on the front panel can be viewed to determine its file number, title or the like.

This problem, i.e., usefully labeling items such as wide, flat stacked files, photograph albums, computer diskette envelopes and the like, has been solved in various ways for specific types of article-receiving folders, envelopes etc. For example, in connection with business folders, it is common to provide indexing tabs extending from the body of articles in registry, which tabs protrude and thus remain visible even though the articles themselves cover one another when placed in registry. The tabs are frequently displaced laterally for successive folders such that the tabs themselves do not overlap. As an alternative solution, file drawers for files placed on edge are usually provided with sufficient room to allow all the files to lean backward, thereby exposing the extreme upper edge of each, insofar as the tilting of the stacked files causes the upper edges to move out of registry. As another alternative, the files can be made extra thick for edge labeling. Phonograph album jackets, audio cassette tapes and the like, are frequently provided with sufficient width along the edge to enable labeling. However, especially with phonograph albums, the space along the edge is quite narrow and hardly adequate to label the item especially as the edges are subjected to wear.

The present invention is especially applicable to file folders and to the sort of article receiving envelopes used to store computer diskettes. Similar to file drawer arrangements, computer diskettes storage file boxes are designed with sufficient space to enable all the diskettes to lean backward, whereupon at least an upper edge of labels positioned near the upper edge may be visible.

Similarly, at a cost of somewhat more depth, the foremost filing envelopes or the like in a drawer can be leaned forward and the rearmost envelopes leaned backward, opening a space exposing the full face of the single envelope at the boundary between the forward and rearward-leaning types. In this case, the forward-leaning envelopes are not visible along their front edges. The rearward-leaning envelopes are visible along a short section of edge due to the tilting of the envelopes. Only the foremost of the rearward leaning envelopes is substantially visible such that a reasonably large label can be examined. In scanning a group of files according to this system, the user is required to flip through the files, leaning them forward one at a time until the desired one is found.

U.S. Pat. No. 4,706,396-Nomura discloses a storage means for computer diskettes. A plurality of pockets for receiving the diskettes are positioned in registry when the storage means is collapsed and are also connected by means of short webs that allow the individual envelopes to be displaced from one another, exposing an edge of the front panel when the storage means is extended. Nomura's device is not subject to reorganization of the order of the envelopes, because the individual envelopes are physically attached permanently to one another by the webs.

In the prior art of card files, an effort has been made to provide a means for attaching successive cards in a card file, for example 3×5 inch index cards, Rolodex telephone cards etc. These cards are not receptacles for articles, but instead are flat sheets, usually of card stock, bearing information on their front faces, and normally flipped between a rearward tilting position and a frontward tilting position to expose the successive front faces when passing from one card to the next.

U.S. Pat. No. 898,034-Brunn discloses a means for engaging index cards to one another. A tab extending from the top of one index card is received in a slot in a next rearward index card. The slot can be formed in several ways, in each case the slot being lower than the fold between the top of the tab and the card. The cards as thus engaged tab-to-receptacle can be stored in registry and by lifting any of the cards, the rear cards in front of that card on the stack are lifted and carried along when the tabs in these front cards engage in the receptacles of the next successive cards to the rear. The top front edge of each card is exposed when the cards are lifted as described, or is covered when the cards are in registry. Among the several different means defining slots in the cards in Brunn are a simple slot (i.e., an elongated hole) through each card, and also a laminated configuration forming a slot at the top and leading to an open bottom between laminated panels. The front and rear panels are glued on opposite sides of intervening side and/or central elements, whereby the space between the front and rear panels defines an opening in which the connecting tab of a next card can be inserted. The cards telescope, but inasmuch as there is no bottom to the structure so formed, the device would not be able to retain a loose article such as a diskette or the like.

U.S. Pat. No. 972,302 -Waller discloses a similar sort of filing system to that of Brunn. A separable linking and sliding element such as a metal strip is attached to each card by means of a fabric hinge, and is received in a slot in a next card. The Waller and Brunn devices are both arranged for telescoping filing cards with information on their fronts, and do not disclose the possibility of telescoping receptacles, or using the pocket of a receptacle as an interlocking telescoping element U.S. Pat. Nos. 2,524,965-Eddy and 1,721,248-Davis teach variations for filing index cards in which two slots in a rear card are oriented vertically, and receive transverse tabs from the front card, the slots being somewhat longer in a vertical direction than the tabs, allowing the rear cards to be lifted with some lost motion relative to the front card, to expose the top front edge of the rear card.

U.S. Pat. Nos. 1,539,411-Davis and 1,238,332-Rand Jr. also disclose means for exposing the top edges of index cards. In each case, however, a supplemental apparatus is disposed under the cards, or means permanently affix the cards at an offset from one another, in order to expose the top front edges of the cards.

The present invention provides a lost motion telescoping connection between containers with pockets for receiving articles, by means of a connection flap from a front such container extending into an article-receiving pocket in a next container to the rear, the containers being stackable in registry and the top edge of rearmost container being exposed by lifting it, until the lost motion connection causes the next successive forward container to be lifted as well. The next container lifts yet a next container, and so on. The flap on the ultimate rearmost container can be turned forwardly to neatly close the stack in a single closed package. Accordingly, containers are stacked in registry in a compact and orderly fashion, but the user can easily scan the labeled edges of a plurality of containers by merely pulling a rearmost container out of registry, engaging the connecting flap of the next successive container, and pulling a plurality of such containers out of registry until locating a desired one. The desired one is easily separated by lifting the next forward container until its flap clears the desired container. The invention can be operated in a vertical-pulling arrangement, and is likewise operable by arranging the flap and pocket for sideways motion. The invention provides a compact and efficient means for storing numerous different types of articles, including but not limited to sheet-like articles such as papers, file folders, computer diskettes, phonograph albums, and sheets and prints generally.

SUMMARY OF THE INVENTION

It is an object of the invention to increase the useful labelling or similar identification area in article-containing folders, envelopes, receptacles and the like, when stored compactly in registry.

It is another object of the invention to provide a means for linking article-carrying items stored in registry such that a short degree of lost motion allows the linked items to be pulled out of registry and thus at least partly exposed to view.

It is a further object of the invention to link pocketed articles directly by engaging the pocket structures on access and allowing the articles, without additional parts or members, while permitting the articles to be re-ordered as necessary.

It is still another object of the invention to facilitate the grouping of related articles by linking together receptacles therefor.

These and other objects are accomplished by a container defining a pocket for receipt of articles, the pocket extending across substantially the full width of the container, the pocket being bounded by a front panel and a rear panel. A connecting flap extends from the rear panel along a fold line, the connecting flap being dimensioned to fit into the pocket of a next container and the fold line on each container being spaced above a top edge of a front panel defining the pocket. Accordingly, two or more containers attached by means of their connecting flaps can be placed in registry or lifted out of registry, the containers telescoping until the front edge on the rear container meets the fold line on the next container to the front, whereupon the telescoping containers lift one another, exposing an edge of the rear panel and/or connecting flap on the rear container. The container is useful for many articles, including without limitation file folders, diskette folders and other article-receiving means, both loosely movable and mounted in file cabinets, briefcases or wall mounts.

BRIEF DESCRIPTION OF THE DRAWINGS

There are shown in the drawings the embodiments of the invention that are presently preferred. It should be understood, however, that the invention is not limited to the precise arrangements and instrumentalities shown in the drawings, wherein.

DETAILED DESCRIPTION OF THE PREFERRED EMBODIMENTS

Figure 1:
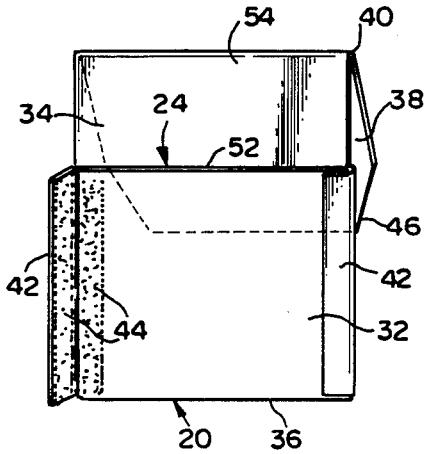
FIG. 1 is a perspective view of a filing container according to the invention, shown in final assembly stages.

A filing container according to the invention as shown in FIG. 1 has a pocket 24 defined by peripherally attached edges of material such as heavy craft stock, around three sides. The pocket is adapted for receiving articles, especially sheet-like articles, but may be deep enough for thicker articles or a large number of stacked thin articles, etc. Pocket 24 extends substantially across the entire width of the article and is of approximately the same size as a connecting flap 38, optionally tapered at edges 46, and folded downwardly from the back of the article.

Filing container 20 is preferably a single integral sheet which is cut, folded and glued to form the structure shown.

A front panel 32 is folded upwardly from a rear panel 34, the rear panel being longer than the front panel up to a fold 40 between rear panel 34 and connecting flap 38. In other words, a top edge 52 of front panel 32 is disposed lower than a fold 40 between connecting flap 38 and rear panel 34.

Pocket 24 is defined by the fold 36 between the front panel 32 and rear panel 34 at the bottom of the container, the sides of pocket 24 being defined by folded over glue tabs 42. Tabs 42 can be integral with the front panel 32 or, as shown, with the rear panel 34. In either case, the tabs 42 are folded around and glued to their respective counterpart to define a pocket 24. The front panel 32 and glue tabs 42 can be glued in any order, i.e. tab 42 on top of panel 32 or vice versa.

A space 54 on the front face of rear panel 34 is left exposed above the top edge 52 of front panel 32. This space is provided for receipt of labelling information, or to allow the front upper portion adjacent the edge of an article placed in pocket 24 to protrude from pocket 24 and thus be exposed for viewing. In other words, the space 54 can be labelled or the article within pocket 24 can protrude into space 54 and thus provide a visible means for identifying the contents.

The particular material of filing container 20 can be chosen based upon the particular application for the folder. For example, in connection with a folder for business documents and the like, manila paper or card stock are suitable. For a more durable composition, the card stock can be made thicker or can be made of or coated with plastic or water-proof material. In the event the whole container 20 is made from plastic, e.g., vinyl, the material can be heated along the fold lines for forming. Alternatively, a rigid or semi-rigid structure can be injection molded to form a self supporting pocket with adequate space for receipt of the articles.

Connecting flap 38 is dimensioned to fit within pocket 24 of a next filing container 20. The flap 38 is preferably tapered along edges 46 for easy insertion. As shown in FIG. 1, flap 38 is sufficiently long to extend below the top edge 52 of container 20 and thus to engage a rearward container 20 to a next frontward container 20 when these containers are placed in registry and the flap of the front one is placed in the pocket of the rear one. Upon the user lifting any container to the rear of another container, the containers displace slightly then engage. For example, top edge 52 of front panel 32 can engage under fold 40 between connecting flap 38 and rear panel 34. Alternatively, the distal end of flap 38 can bottom out in the next container's pocket 24 after the desired amount of lost motion. Engagement for lifting occurs when the rear container is lifted by sufficient amount to cause the flap 38 and pocket 24 to engage, for example a distance equal to the height of exposed area 54. To separate the containers, a front container can be lifted until its flap 38 is free of the rear container. When the container is put back in the stock, engagement is resumed by returning the flap 38 into pocket 24. This allows the telescoping chain to be interrupted, for example between categories of filed items.

Figure 3:
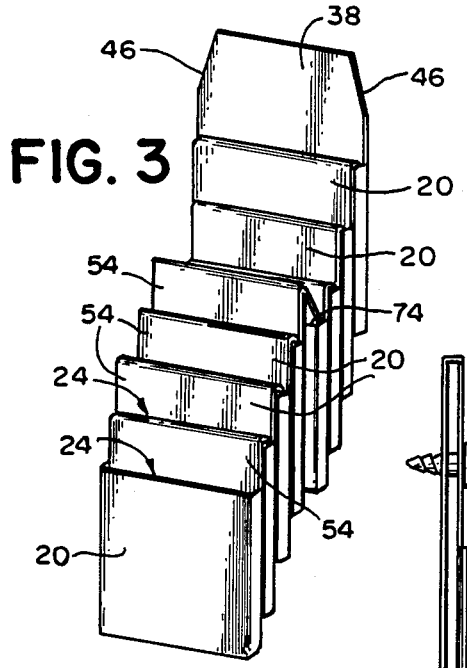
FIG. 3 is a perspective view showing a plurality of filing containers and outer containers disposed out of registry with one another.
Figure 2:
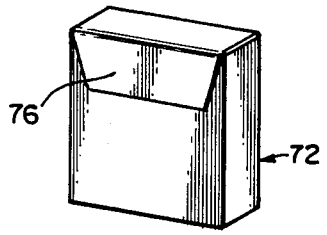
FIG. 2 is a perspective view of an outer container according to the invention.
Figure 7:
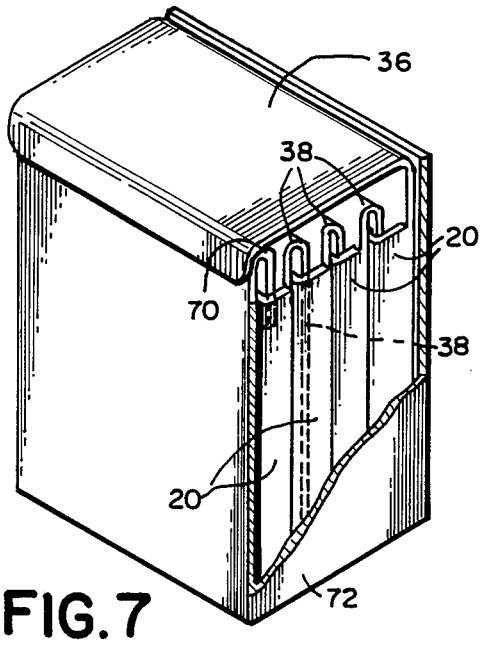
FIG. 7 is a partial perspective view of assembled inner and outer containers in a closed package.

A plurality of these filing containers 20 can be stored within an outer container 72, shown in FIGS. 2 and 7–9. The outer container can be a separate means for storing articles, functioning as an organizer for sheets labeled according to the categories appearing either on the sheets or on the exposed edges 54 of filing containers 20 within container 72. Similarly, outer container 72 can itself be made according to the invention, i.e., arranged such that flap element 76, when folded backwardly along a fold line, will engage in a next successive container 72 in the same manner as with containers 20 as shown in FIG. 3. The individual containers 20 can define a closed discrete package by linking the rearmost container in a stack to the foremost container in the stack. The flap 36 of the rearmost container is folded forward over the tops of all the containers as shown in FIG. 7, and then bent downwardly into the pocket of the foremost container, closing the stack in a neat unit.

If a plurality of telescopically-connected containers are disposed in an outer container 72 as in FIG. 7, last flap 36 can extend over the front of the outer container, and if desired can be received in a slot (not shown) in the front of the outer container.

As shown in FIG. 3, the connecting flaps 38, of the containers 20 (and/or flaps 76 of containers 72 assuming containers 20 and 72 are made the same) are preferably tapered along edge 46 for easier insertion in a next successive container. In each case the flaps 38 or 36 (or 76) is long enough to tuck into a next container.

Figure 8:
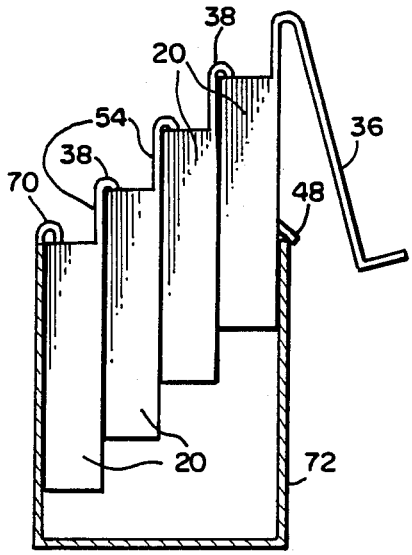
FIG. 8 is a side view of an open and telescoped view of the package as in FIG. 7, a side of the outer container being shown cut away.
Figure 9:
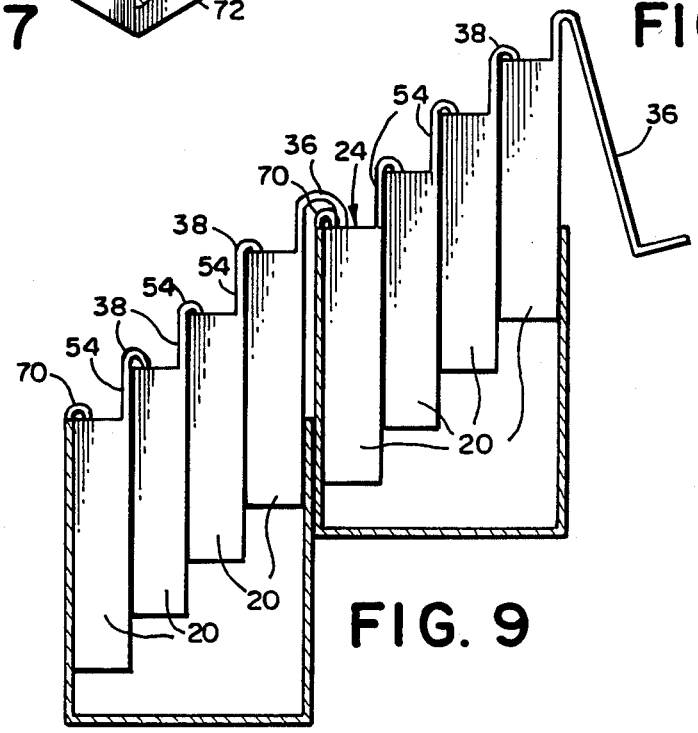
FIG. 9 is a side view of a plurality of telescoped packages connected together, a side of the outer containers shown cut away.

It is also possible to engage the filing containers 20 in other forms of article receptacles by simply placing connecting flap 38 into the article receptacle, thus hanging the container 20 and/or 72 from the receptacle, either due to flap 38 bottoming out in the receptacle, or if flap 38 is shorter than the depth of the receptacle's pocket, then hanging the container 20 by the fold of flap 38 from the top front edge of the pocket in which flap 38 is placed. In the embodiment in FIGS. 7–9, containers 20 are disposed in outer containers 72. The outer containers in this case are not separately connectable items except due to engagement with connectable filing containers 20 therein. Containers 20 are each connected to one another within the pocket defined the front and rear panels of outer container 72 and are therefore liftable to expose the top edges 54 of the rear panels 34, or articles within the pockets 24 that may extend into this area. Insofar as the filing containers 20 within a given outer receptacle 72 are telescoped to one another, they define in themselves a single discrete article in the pocket 24 of container 72. The single discrete article can be formed into a closed package by placing the flap 38 of the rearmost container 20 into the pocket of the foremost container 20. In FIGS. 7–9 the outer container 72 has an inward-facing flap 70 that engages the foremost container such that outer container 72 remains fixed to the inner container 20 whether in registry (FIG. 7) or telescoped (FIGS. 8 and 9). In FIG. 9, both the short flap 70 of outer container 72 and the longer flap 36 of the rearmost container 20 of the front stack fit into pocket 24 of the foremost container 20 of the rear stack.

Figure 4:
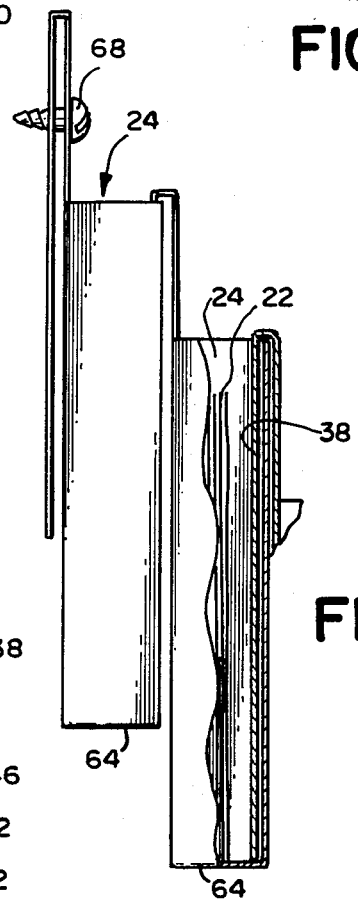
FIG. 4 is a partial section view of an article-holding means according to the invention.

FIG. 4 shows an embodiment wherein the individual containers are wide enough to define a substantial depth, nevertheless being arranged with connecting flaps to engage one another. The wider filing containers 64 can be provided with a special front pocket (not shown) for the connecting flaps, defined by dividing walls separating the flap-receiving area from the article-receiving area or by slots in the front panel. It is preferred, however, that flaps 38 extend into the same pocket as any articles.

An uppermost or rearmost one of the containers can be provided with means 68 for mounting a whole telescoped chain of containers. The number of containers chainable in this way is limited only by the total weight carried by the rearmost flap 38 in the chain. Means 68 are shown in FIG. 4, for example a screw, through the container flap. It will be appreciated that other alternatives are likewise available for affixing the rearmost connecting flap to desired structure. When a rearmost flap is affixed to support means, it is of course not possible to use the rearmost flap to close over the top of the stack.

The invention herein is described for convenience in connection with lifting the rearmost container to expose area 54 thereof. In this context, "lifting" is not limited to displacement in a vertical direction. The containers 20, 72 can also be positioned such the pocket 24 opens laterally of the stack, in which case the nested telescoping articles can be pulled ("lifted") out of registry in a horizontal direction instead of a vertical one, within the scope of the invention. Of course in that case, the user will not have gravity to assist in replacing the filing containers in registry, but will have to push them back into registry after having viewed the exposed edges, removed needed articles, etc.

Figure 5:
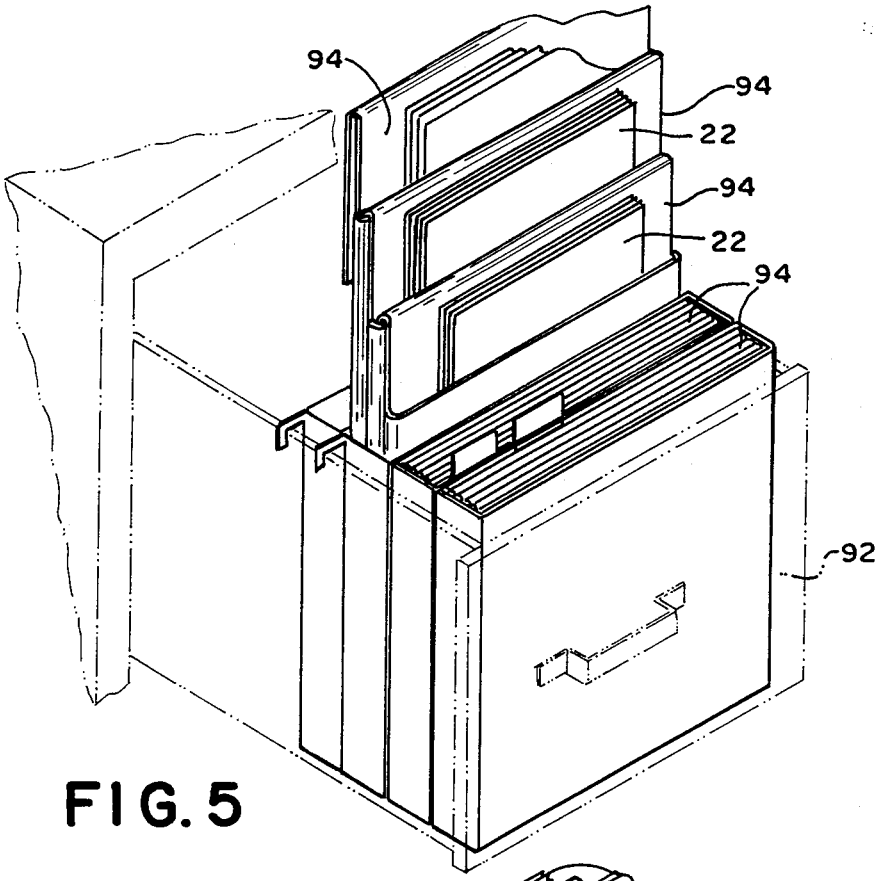
FIG. 5 is a perspective view of the invention as applied to a file drawer.

FIG. 5 shows an application of the invention to business size filing folders in a filing cabinet 92. The individual files 94 in the drawer are each provided with a connecting flap folded from their rear panels and adapted to engage in the pocket of a next file 94. The fold between the rear panel and the connecting flap is spaced from the extreme edge of the front panel defining the pockets such that as shown in FIG. 5 the rearmost panel can be lifted to expose articles 22 in the pockets. These articles 22 can be labeled if desired. Alternatively, the articles 22 can be placed fully within the pocket defined by the filing container and other labels placed on the exposed edges of the rear panels of folders 94. Unlike known file cabinet situations in which extra file depth must be provided to allow folders ahead of a desired folder to tilt forward toward the front of the drawer, the rearward folders leaning toward the back of the drawer and only one folder being exposed, folders according to the present invention can be positioned precisely vertically and directly in contact with one another, yet a number of the folders can be viewed at the same time. Furthermore, the engagement between successive folders 94 is such that the connected folders define a wide-based self-supporting structure that will remain vertical, precluding the necessity for spacers and the like as also used in known file drawers to urge the folders forward against falling over onto the bottom of drawer 92.

Figure 6:
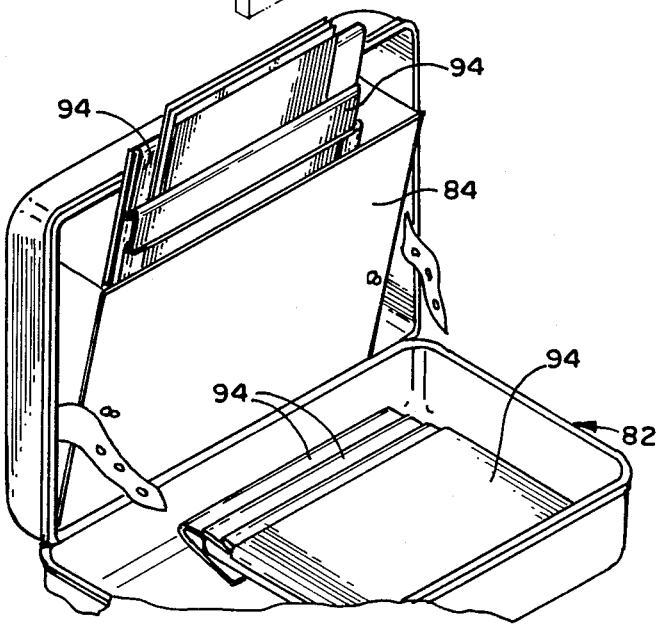
FIG. 6 is a perspective view of the invention as applied to a briefcase.

Connected folders 94, as shown in FIG. 6, can be stored loosely, connected in a chain, or engaged together with permanently-mounted pocketed articles in a device such as a briefcase, all at the user's option. In FIG. 6, one group of connected file folders 94 is positioned loosely in the bottom of a briefcase 82 and another group is engaged in a telescoping manner within the upper accordion-expandable receptacle 84 in the top half of the briefcase. If desired, the receptacle 84 can be a rearmost one of a plurality of connected elements. Receptacle 84, or any other of the connectable elements 20 or 72, can have accordian folded sidwalls as in FIG. 6.

The physical connection between successive containers 20 can result from engagement between the fold 40 between connecting flap 38 and rear panel 34, over the top edge 52 of the front panel 32 as shown in FIG. 1. FIG. 7 shows that it is also possible to use the lowermost edge of the connecting flap as a structural support. This is done by making the connecting flap 38, shown in phantom in FIG. 7, long enough to bottom out in the next receptacle pocket whereby support for the connecting flap is provided by the bottom of the container as well as by the top edge of the front panel which defines the article-receiving pocket. Instead of or in addition to using the article-receiving pocket, one or more slots can be defined in the front panel of a container for receiving a flap 38, which slots define a pocket operably engaging the distal end of the connecting flap in the same lost motion manner that the fold of the connecting flap engages the top edge of the pocket in the embodiments described above.

In FIG. 8, means on rear wall of a container 20 are provided for temporarily locking a stack in telescoped position. A tab 48, which can be raised from a last container 20, engages over the top edge of container 72 to hold the position of this last container, and accordingly holding all the containers in exposed condition. FIG. 8 also shows that the flap 36 of the last container can be extra long and/or provided with a folded end for sealing over containers 20.

The telescoping file system as disclosed is a mechanism which allows general purpose file folders to be arranged in a telescoping fashion and thus makes each file easily accessible. The telescoping action gives the device the ability to serve multiple functions and provides greater utility than known filing envelopes, file folders and the like. In a collapsed position, the invention is a compact, stackable shipping carton or travel case. By expanding it, the user can view the contents. Moreover, the device can be left in the expanded condition in its normal state, becoming a space-saving wall hanging or the like, well adapted for filing articles in visible arrays near the point of their use, and also well adapted as a display apparatus at the point of sale. Wall mounting offers unlimited modular expansion, by way of either hanging the individual filing containers 20 on one another or by providing outer containers 72 and inner containers 20, either of which nest to other pocketed containers to define telescoping groups. All of the file label areas are easily visible at a glance, without thumbing through folders and without even opening a drawer. Moreover, the visible portion of the element can be as wide as required, and is aptly labeled either directly on the container or by exposing an article contained in the pocket. The device may also function as an original container for an article of sale, and after shipping, the container can be engaged with other similar containers in a telescoping file system.

According to a preferred embodiment, three to five or more inner folders are telescoped and the rearmost 36 flap is folded forward, optionally being tucked into the foremost pocket. This package is placed in an outer box. The inner folders are dimensioned for receipt of papers, diskettes, record albums and the like, to name but a few examples. After die cutting the integral sheet to be formed into the folder 20, the parts are folded and glued. The connecting flaps of the boxes (or containers) can be arranged to provide a rearward tilting support for the box, or other means similar to the die cut rear support used for picture frames supported on desks can be employed. Preferably, the inner pockets are flat and the outer containers are squared. It is also possible as shown to subdivide the available area by ridging the sides of the pocket with folds or guide flanges, or by providing an accordion folding side for either the inner pockets, the outer boxes, or both.

A number of especially apt uses for the container of the invention are storage of diskettes, CD ROMS, paper sheets such as forms, documents and notes. A smaller arrangement is feasible for pocket-carried credit cards and a larger arrangement functions as an in/out basket, mail slot or display means for project management materials. In addition to engaging together a plurality of identical containers such as envelopes, it is also possible to engage together a plurality of distinct items which are different but are useful together, for example a calculator, checkbook and note pad. In general, this arrangement is also suitable for display of articles in retail establishments, for example retail sale of greeting cards, magazines, records and the like. The device remains useful as a filing means after delivery as a shipping container. The carton thus adds value to the product shipped. Nevertheless, the receptacles are compact, neat and professional.

When wall mounted, the entire contents of inventory are readily visible. The inventory, however, is continuously and indefinitely expandable, eliminating the need for various forms of cabinets and filing apparatus.

A number of additional alternatives are possible, and will now be apparent in view of this disclosure.

The invention as defined herein is a container comprising means defining a pocket for receipt of articles, the pocket extending across substantially a full width of the means and the means including a front panel and a rear panel. A connecting flap attached along a fold line to an edge of the rear panel has a width less than the width of the pockets such that the connecting flap can be inserted in the pocket of a second container placed behind the first container when the connecting flap is folded backwards on the fold line. The fold line is preferably parallel to and spaced from edge of the pocket defined by the front panel, whereby the first container is attachable neatly in registry with the second container and movable out of registry with the first container until such time as a part of the flap engages a part of the pocket, e.g., the pocket defining edge of the front panel abuts the fold line. This movement exposes an edge of the second container and/or an article in the pocket thereof. The connecting flap can also be arranged to abut the pocket by bottoming out in the pocket by the distal end of the connecting flap. Whether abutting by the fold line meeting the opening edge of the pocket or by the distal end of the flap bottoming out in the pocket, in either case the first and second containers are displaceable out of registry for a limited distance and upon further movement become fixed together.

The container can be a folder with a pocket dimensioned for the receipt of sheet materials, or can have a plurality of pockets, at least one of the pockets being dimensioned for receipt of the connecting flap. The container and its respective parts are preferably parts of an integral sheet that is cut and folded to define the pocket and the connecting flap. A front panel is preferably attached to the rear panel along at least one side defining the pocket, and preferably along three sides. One or more gluing tabs can be folded around from the front or rear panel forming the pocket, to define the three closed sides of the pocket. The filing containers as so disclosed can be arranged such that the fold line is at a top edge of the front panel or a side edge of the front panel, whereby the rear container is either lifted or pulled transversely out of registry with the stack, respectively.

The pockets and the articles therein are preferably standard size elements, for example dimensioned as standard file elements for familiar articles in sizes of 3×5, 4×6, 5×7, 8×10, 8.5×11, 8.5×13, 8.5×14 inches or other standard sizes such as international A4 size. Similar standard dimensions are appropriate for computer diskettes or the like, for example having pockets for articles of 3.5, 5.25 or 7.5 inches width, and the pockets being dimensioned to expose a labeled edge at the top of a diskette.

In addition to the concept of individual telescoping containers, the invention also concerns a telescoping filing system, comprising a plurality of such filing containers, each having means defining at least one pocket for receipt of articles, the means including a front panel, a rear panel and a connecting flap joined along a fold line to an edge of the rear panel, each connecting flap movably mating with a corresponding pocket over a limited displacement, the connecting flap having a width less than the width of the pocket, the connecting flap of a first set filing container being fittable in the pocket of a second set filing container placed behind the first filing container when the connecting flap of the first filing container is folded backwards on the fold line. The flap of the rearmost container can be folded forwardly into the pocket of the foremost container binding the containers in a discrete package. The fold line is parallel to and spaced from an edge of the pocket defined by the front panel, whereby said first filing container is attachable in registry with the second set filing container by placing the connecting flap of the first filing container in the pocket of the second filing container. The second filing container can be movable out of registry with the first until the pocket defining edge of the front panel abuts the fold line, or until the connecting flap bottoms out in the pocket, in either case exposing the second filing container along an edge thereof and then fixing together the first and second containers.

An outer enclosure is preferably provided for receiving a plurality of said filing containers, the outer enclosure holding the filing containers in registry until a rear one of the filing containers is drawn out of registry. The outer enclosure can be a larger version of the filing container, having the same pocket and connecting flap arrangement and being attachable in registry to other such outer enclosures in the same manner as the filing containers were attachable to one another. The filing containers can be elements of a filing cabinet, for example a hanging drawer system. The filing containers can likewise be elements of a briefcase. In each case, the telescoping filing arrangement is a neat and effective accommodation of the needs to compactly store items in registry, and to enable viewing of labeled edges of the items.

I claim:

1. A container, comprising:

means defining a pocket for receipt of articles, the pocket holding the articles within the container;

a connecting flap connected along a fold line to an edge of the rear panel, the connecting flap having a width closely dimensioned to a width of the pocket, the connecting flap of a first said container being fittable in the pocket of a second said container when the connecting flap of the first container is folded backwards on the fold line with said rear panels; and, the flap having a portion spaced from an abutting portion of the pocket when the first and second containers are in registry, the first container being attachable in registry with the second container by placing the connecting flap of the first container in the pocket of the second container, whereupon the first container and the second container are supported solely by the connecting flap of the first container and the second said container is movable out of registry with the first container until the connecting flap portion abuts the portion of the pocket to fix the first said container to the second said container, exposing the second container along an edge thereof.

2. The container of claim 1, wherein the fold line is parallel to the edge of the pocket defined by the front panel and the connecting flap abuts the pocket when the fold line abuts an opening edge of the pocket.

3. The container of claim 1, wherein the connecting flap abuts the pocket when a distal end of the connecting flap bottoms out in the pocket.

4. The container of claim 1, wherein the container is a folder having a plurality of pockets, at least a front one of the pockets being dimensioned for receipt of the connecting flap.

5. A telescoping filing system, comprising:

a plurality of filing container, each having means defining at least one pocket for receipt of articles, said means including a front panel, a rear panel and at least one connecting flap joined along a fold line to an edge of the rear panel, each connecting flap movably mating with a corresponding pocket over a limited displacement, thereby restricting sideways displacement of the connecting flap and the pocket, the connecting flap having a width slightly less than the width of the pocket, the connecting flap of a first said filing container being fittable in the pocket of a second said filing container placed behind the first filing container when the connecting flap of the first filing container is folded backwards on the fold line, the fold line being spaced from an edge of the pocket defined by the front panel, whereby said first filing container is attachable in registry with the second said filing container by placing the connecting flap of the first filing container in the pocket of the second filing container, and the second said filing container is movable out of the first filing container until the connecting flap and pocket engage by at least one of the connecting flap bottoming out in the pocket, and the edge of the front panel abutting the fold line, exposing the second filing container along an edge thereof.

6. The filing system of claim 5, further comprising an outer enclosure for receiving a plurality of said filing containers, the outer enclosure holding the filing containers in registry until a rear one of the filing container is drawn from the outer enclosure.

7. A telescoping filing system, comprising:

a plurality of filing container, each having means defining at least one pocket for receipt of articles, said means including a front panel, a rear panel an at least one connecting flap joined along a fold line to an edge of the rear panel, each connecting flap movably mating with a corresponding pocket over a limit displacement, the connecting flap having a width less than the width of the pocket, the connecting flap of a first said filing container being fittable in the pocket of a second said filing container placed behind the first filing container when the connecting flap of the first filing container is folded backwards on the fold line, the fold line being spaced from an edge of the pocket defined by the front panel, whereby said first filing container is attachable in registry with the second said filing container by placing the connecting flap of the first filing container in the pocket of the second filing container, and the second said filing container is movable out of registry with the first filing container until the connecting flap and pocket engage by at least one of the connecting flap bottoming out in the pocket, and the edge of the front panel abutting the fold line, exposing the second filing container along an edge thereof; and, an outer enclosure for receiving a plurality of said filing container, the outer enclosure holding the filing containers in registry until a rear one of the filing containers in registry are closable as a unit by folding containers is drawn from the outer enclosure, and wherein the the connecting flap of a rearmost container forwardly.

8. The filing system of claim 6, further comprising a raisable tab on at least the rear one of the containers, the tab engaging a top of the outer enclosure to hold the containers in telescoped position.

9. The filing system of claim 6, further comprising an inward facing flap on the outer enclosure for insertion into a pocket of a foremost one of the containers, whereby the outer enclosure is attached to the foremost one.

10. The filing system of claim 6, wherein the outer enclosure is an element of a briefcase.

11. A filing envelope, comprising:

an integral sheet element having a front panel and rear panel folded over one another and attached to one another along three edges, the front panel and the rear panel being separable along a fourth edge and defining a closed-bottom pocket extending substantially across a full width thereof;

a connecting flap extending from the rear panel and foldable relative to the rear panel at a space from the fourth edge, the connecting flap being foldable along a line parallel to said fourth edge, whereby the filing pocket is attachable in registry with means defining a pocket for receiving the connecting flap, the means defining the pocket for the connecting flap being movable relative to the connecting flap until said means defining the pocket abuts the fold line; and, an outer container for said filing envelope, the outer container also having a connecting flap and being attachable to additional outer containers for holding said filing envelopes.

12. The filing envelope of claim 11, wherein the filing envelope is a business folder having receptacles in addition to said pocket.

13. A telescoping filing system, comprising:

a plurality of filing containers, each having means defining at least one pocket for receipt of articles, said means including a front panel, a rear panel and at least one connecting flap joined along a fold line to an edge of the rear panel, each connecting flap movably mating with a corresponding pocket over a limited displacement, the connecting flap having a width less than the width of the pocket, the connecting flap of a first said filing container being fittable in the pocket of a second said filing container placed behind the first filing container when the connecting flap of the first filing container is folded backwards on the fold line, the fold line being spaced from an edge of the pocket defined by the front panel, whereby said first filing container is attachable in registry with the second said filing container by placing the connecting flap of the first filing container in the pockets of the second filing container, and the second said filing container is movable out of the first filing container until the connecting flap and pocket engage by at least one of the connecting flap bottoming out in the pocket, and the edge of the front panel abutting the fold line, exposing the second filing container along an edge thereof, and wherein the connecting flaps are large enough that the containers in registry are closable as a unit by folding the connecting flap of a rearmost container forwardly, the connecting flap of the rearmost container forming an at least partial outer enclosure.

* * * * *